US008816604B2

(12) United States Patent
Carli

(10) Patent No.: US 8,816,604 B2
(45) Date of Patent: Aug. 26, 2014

(54) DIMMING CONTROL METHOD AND APPARATUS FOR LED LIGHT SOURCE

(75) Inventor: Giampaolo Carli, Saint-Lazare (CA)

(73) Assignee: GE Lighting Solutions, LLC., East Cleveland, OH (US)

( * ) Notice: Subject to any disclaimer, the term of this patent is extended or adjusted under 35 U.S.C. 154(b) by 187 days.

(21) Appl. No.: 13/566,105

(22) Filed: Aug. 3, 2012

(65) Prior Publication Data

US 2014/0035484 A1 Feb. 6, 2014

(51) Int. Cl.
*H05B 37/02* (2006.01)

(52) U.S. Cl.
USPC ..... 315/297; 315/247; 315/185 R

(58) Field of Classification Search
None
See application file for complete search history.

(56) References Cited

U.S. PATENT DOCUMENTS

| | | | | |
|---|---|---|---|---|
| 6,580,309 | B2 | 6/2003 | Jacobs et al. | |
| 6,586,890 | B2 | 7/2003 | Min et al. | |
| 6,844,760 | B2 | 1/2005 | Koharagi et al. | |
| 7,119,498 | B2 | 10/2006 | Baldwin et al. | |
| 7,615,974 | B1 | 11/2009 | Xu | |
| 7,642,735 | B2 | 1/2010 | Gulsen et al. | |
| 8,169,159 | B2 * | 5/2012 | Lu et al. | 315/307 |
| 8,228,005 | B2 * | 7/2012 | Ohtaka et al. | 315/307 |
| 2006/0082538 | A1 | 4/2006 | Oyama | |
| 2007/0210725 | A1 | 9/2007 | Marosek | |
| 2009/0273290 | A1 * | 11/2009 | Ziegenfuss | 315/193 |
| 2010/0219764 | A1 | 9/2010 | Yamasaki | |
| 2011/0080111 | A1 | 4/2011 | Nuhfer et al. | |
| 2014/0055051 | A1 * | 2/2014 | Raval et al. | 315/193 |

FOREIGN PATENT DOCUMENTS

| | | | |
|---|---|---|---|
| DE | 602005004502 | | 1/2009 |
| EP | 1986470 | A2 | 10/2008 |
| JP | 2009054425 | A | 3/2009 |
| WO | 2004057924 | A1 | 7/2004 |
| WO | 2007106123 | A1 | 9/2007 |
| WO | 2007141741 | A1 | 12/2007 |
| WO | 2011024101 | A1 | 3/2011 |

OTHER PUBLICATIONS

Int'l Search Report and Written Opinion dated Jul. 3, 2014 from corresponding Application No. PCT/US2013/052653.

* cited by examiner

*Primary Examiner* — Jany Richardson
(74) *Attorney, Agent, or Firm* — GE Global Patent Operation; Peter T. DiMauro

(57) ABSTRACT

A light emitting diode (LED) light source, LED driver circuitry and methods for controlling the brightness of an LED light source are presented. In some embodiments, an LED driver control circuit receives a dimming command signal to dim the LED light source, modulates a continuous direct current (DC) level to dim the LED light source, and determines that a predetermined threshold level has been reached. At this time, the process includes initiating a fixed pulse width generator (PWG) control signal having a fixed duty cycle, automatically adjusting the LED current amplitude to its nominal current level, and decreasing the current amplitude while the fixed PWG control signal is active to achieve commanded lower dimming of the LED light source.

16 Claims, 3 Drawing Sheets

DIMMING CONTROL METHOD AND APPARATUS FOR LED LIGHT SOURCE

BACKGROUND

Light-emitting diode (LED) light sources are becoming more common in the marketplace. Originally used to replace conventional incandescent, fluorescent, or halogen lamps, and the like in homes, LED light sources are now becoming more commonly used in products such as automobiles. Their increased use is not surprising as LEDs are typically more efficient than conventional incandescent light bulbs and the like, and have longer operational lives.

In some implementations, LED light sources include a plurality of light-emitting diodes provided in a suitable housing. LEDs are current-dependent components, and thus in order to illuminate LEDs properly an LED driver control device (an LED driver) is typically coupled between an alternating-current (AC) source and the LED light source to regulate the power supplied to the LED light source. The LED driver may regulate the current supplied to the LED light source to a specific peak current value, or regulate the voltage provided to the LED light source to a particular value, or may regulate both the current and the voltage.

Many different LED driver configurations are known, and some provide power by using pulse-width modulation (PWM). Some driver circuit designs switch an LED power supply unit on and off using a pulse duration modulator to control the mean light output of the LEDs. Thus, PWM signals may be used to alter the brightness and color of LEDs.

The light output of an LED is proportional to the current flowing through it, and thus methods have been developed to control the current delivered to an LED light source. For GaInN type LEDs, a typical load current is about 350 milliamps (mA) at a forward operating voltage of between three and four volts (3V-4V), which corresponds to about a one watt (1 W) power rating. At this power rating, this type of LED provides about 100 lumens per watt which is significantly more efficient than conventional light sources. For example, incandescent lamps typically provide 10 to 20 lumens per watt and fluorescent lamps, 60 to 90 lumens per watt.

LED light sources usually include a plurality of individual LEDs that may be arranged in both a series and parallel relationship. Thus, a plurality of LEDs may be arranged in a series string and a number of series strings may be arranged in parallel to achieve a particular desired light output.

LED light sources are typically rated to be driven via either a current load control technique or a voltage load control technique. An LED light source that is rated for the current load control technique is also characterized by a rated current (for example, 350 mA) to which the peak magnitude of the current through the LED light source is regulated to ensure that the LED light source is illuminated to the appropriate intensity and color. In contrast, an LED light source that is rated for the voltage load control technique is characterized by a rated voltage (for example, 15 V) to which the voltage across the LED light source should be regulated to ensure proper operation of the LED light source. Typically, each string of LEDs in an LED light source rated for the voltage load control technique includes a current balance regulation element to ensure that each of the parallel legs has the same impedance so that the same current is drawn in each parallel string.

It is also known that the light output of an LED light source can be dimmed by using a pulse-width modulation (PWM) technique and a constant current reduction (CCR) technique. PWM dimming can be used for LED light sources that are controlled in either a current or voltage load control mode. In PWM dimming, a pulsed signal with a varying duty cycle may be supplied to the LED light source.

If an LED light source is being controlled using the current load control technique, the peak current supplied to the LED light source is kept constant during an On-time of the duty cycle of the pulsed signal. But as the duty cycle of the pulsed signal varies, the average current supplied to the LED light source also varies to vary the intensity of the light output of the LED light source.

If the LED light source is being controlled using the voltage load control technique, the voltage supplied to the LED light source is kept constant during the On-time of the duty cycle of the pulsed signal in order to achieve the desired target voltage level, and the duty cycle of the load voltage is varied in order to adjust the intensity of the light output.

Constant current reduction dimming is typically only used when an LED light source is being controlled using the current load control technique. In constant current reduction dimming, current is continuously provided to the LED light source, however, the DC magnitude of the current provided to the LED light source is varied to thus adjust the intensity of the light output.

There remains a need in the art for an energy-efficient and simple LED driver circuit to control dimming of an LED light source. with reduced component count.

SUMMARY OF THE INVENTION

In an embodiment, a light emitting diode (LED) light source includes at least one LED and a driver control circuit for controlling the brightness of the LED. The driver control circuit includes a power circuit operable to receive input power (either an alternating current (AC) or a direct current (DC)) and to generate a direct current to power the at least one LED, and at least one of a comparator or an amplifier having a current sense signal input and a dimmed current reference command signal input. The comparator or amplifier generates a control signal output that controls the power circuit to dim the at least one LED by decreasing the amplitude of LED current when the control signal is above a predetermined threshold. The driver control circuit also includes a fixed pulse width generator (PWG) having an output connected to the power circuit, wherein the fixed PWG is configured to operate with a predetermined fixed duty cycle, and a comparator circuit having a predetermined threshold signal input and a dimming command signal input. When the dimming command signal is above the predetermined threshold the comparator circuit disables the fixed PWG to dim the at least one LED. In addition, the comparator circuit enables the fixed PWG when the dimming command signal decreases below the predetermined threshold level resulting in the power converter circuit being controlled On-Off with the predetermined fixed duty cycle. The current amplitude level is automatically adjusted in response to the dimming command signal and the activation of the PWG in order to further dim the at least one LED.

Advantageously, the driver control circuitry may include an averager circuit or a low-pass filter having an output connected to the comparator or amplifier circuit, wherein the averager circuit or low-pass filter operates to extract the average value of the sensed load current. By so doing, the control loop automatically adjusts the current amplitude level in response to the activation of the PWG in order to further dim the at least one LED. Beneficially, in some implementations, the power circuit may further include an integrated circuit (IC) for controlling of a boost, buck, buck-boost, SEPIC, hysteretic, or flyback-type topology. In addition, in some advantageous embodiments the fixed PWG component is one of a fixed 555 timer circuit or a ripple counter circuit, and the power converter circuit is controlled On-Off within a frequency range of 100 Hertz to 2 Kilohertz.

A method for controlling brightness of an LED light source is also described. In some embodiments, the process includes receiving, by an LED driver control circuit, a dimming command signal to dim an LED light source, and then modulating a continuous direct current (DC) level to dim the LED light source. When it is determined that a predetermined threshold level has been reached, the process includes initiating a fixed pulse width generator (PWG) control signal having a fixed duty cycle, automatically adjusting a current amplitude to its nominal current level, and decreasing the current amplitude while the fixed PWG control signal is active to achieve commanded lower dimming of the LED light source.

In some beneficial embodiments, the predetermined threshold level comprises a percentage of a dimming range, which may be ten percent. In addition, the duty cycle of the fixed PWG control signal may advantageously be a percentage of a peak current, and in some embodiments the duty cycle is twenty-percent. The process may advantageously also include determining that the dimming command signal is greater than the threshold level, and then modulating the continuous direct current (DC) level to dim the LED light source.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

Like reference numbers in the drawings indicate the same or similar elements.

DETAILED DESCRIPTION

The inventor recognized that a need exists for an energy-efficient and simple LED driver circuit to control dimming of an LED light source down to dimming levels below ten percent, wherein such an LED driver circuit has a reduced component count as compared to prior art configurations. Embodiments of such are described hereinbelow with reference to FIG. 2A, FIG. 2B, and FIG. 3.

Figure 1A:
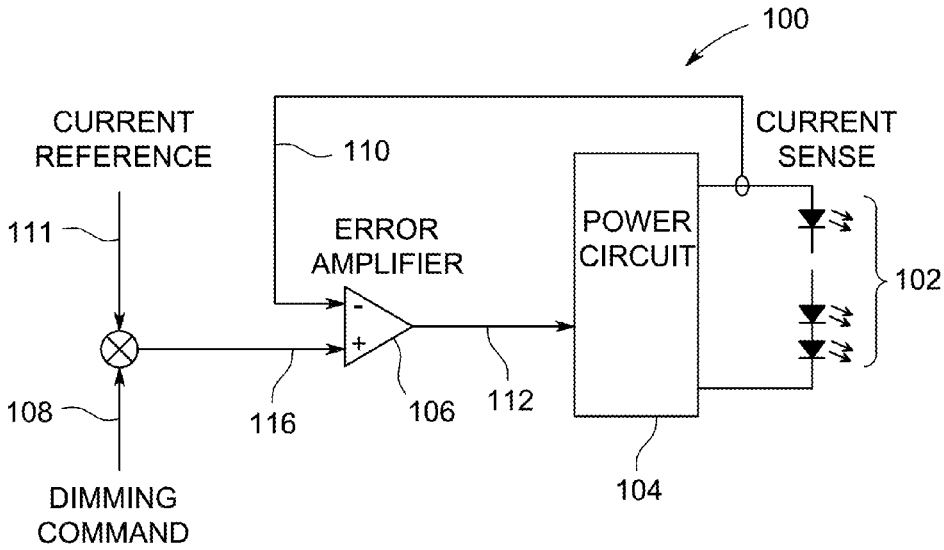
FIG. 1A(PRIOR ART)
FIG. 1A is a schematic block diagram of a prior art amplitude modulated dimming circuit.

FIG. 1A is a schematic circuit diagram illustrating a conventional driver control system 100 with amplitude modulation (AM) dimming control for an LED light source 102 that includes a plurality of LEDs in a series configuration. Amplitude modulated dimming is also known in the industry as linear dimming or continuous dimming. A power circuit 104, which may include an integrated circuit (IC) for control of a boost, buck, buck-boost, SEPIC, hysteretic, or flyback power topologies and the like, operates to control the amplitude of a DC (direct current) load current through the series of LEDs 102. A comparator/amplifier circuit 106 operates to monitor the LED current (by utilizing the LED current sense feedback input 110) and to produce an appropriate error voltage signal 112 (that may be compensated in order to achieve loop stability) that is fed to the power circuit 104 for LED current regulation. A dimming function can be implemented by simply mixing a dimming command signal 108 (which may be generated by a dimming control circuit, not shown) with the current reference 111 in order to obtain a dimmed current reference signal 116. When the dimmed current reference signal 116 falls below ten percent (10%) of the full load level, then the load current supplied to the LED light source 102 is amplitude-modulated to a direct current (DC) level that is too small to avoid flickering and significant color change of the LEDs of the LED light source 102. These are sub-optimal results which are to be avoided in most LED lighting situations.

Figure 1B:
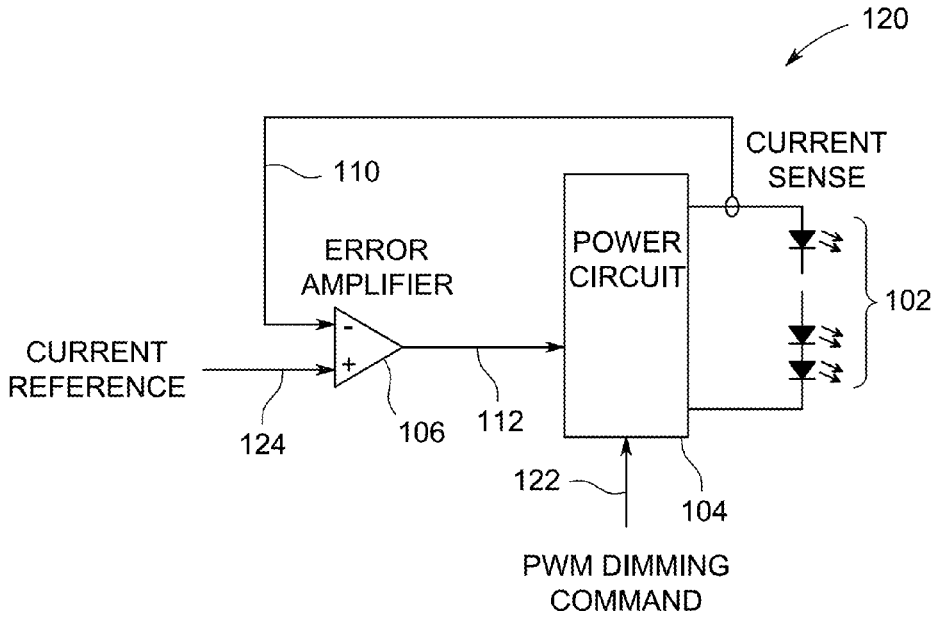
FIG. 1B(PRIOR ART)
FIG. 1B is a schematic block diagram of a prior art pulse-width modulated (PWM) modulated dimming circuit.

FIG. 1B shows another conventional dimming circuit diagram 120 that utilizes a pulse width modulated (PWM) control function. In this case the amplitude of the current is not varied as a function of a dimming command; rather, the dimming command is provided directly to the power circuit 104 in the form of a PWM signal 122. Thus, the current reference 124 is fed directly into the comparator/amplifier circuit 106, which again operates to monitor the LED current and to produce an appropriate error voltage signal 112. The power circuit responds to the PWM signal 122 by allowing current to flow in the LED string 102 during the "On" level of the PWM signal, and by inhibiting current from flowing in the LED string during the "Off" level of the PWM signal.

Figure 2A:
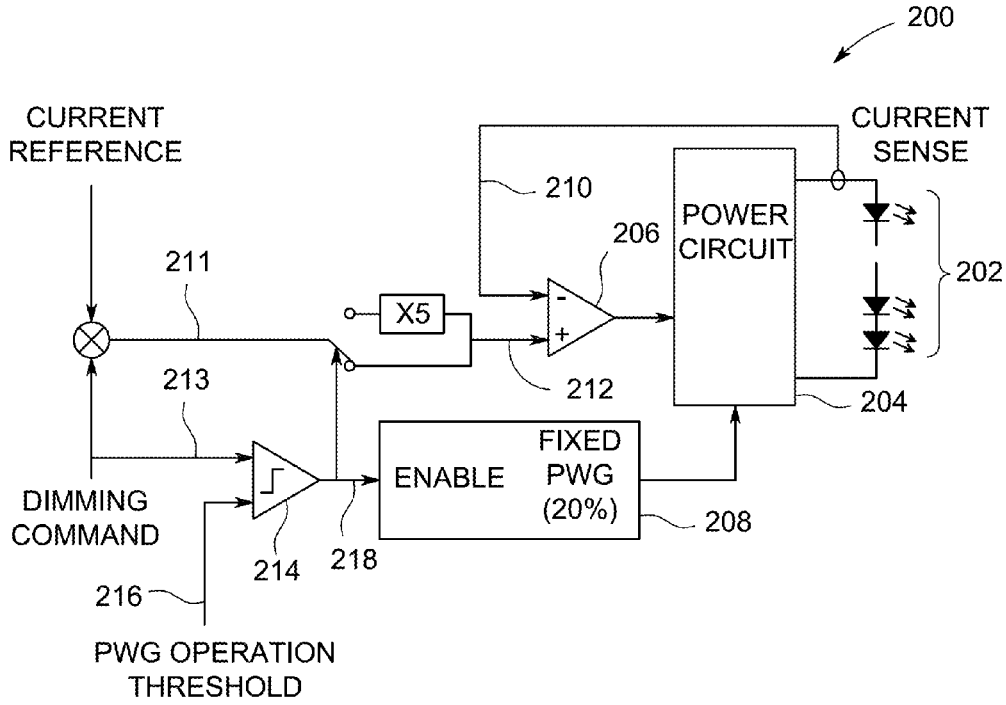
FIG. 2A is a schematic block diagram of an LED dimming circuit in accordance with aspects of the present invention.

FIG. 2A is a schematic circuit diagram of an LED driver control system 200 according to an embodiment of the invention. In some embodiments, the LED light source 202 includes a plurality of LEDs in series. In this implementation, the system includes a power circuit 204 (which may include an integrated circuit (IC) for control of a boost, buck, buck-boost, SEPIC, hysteretic, or flyback power topologies and the like) which operates to control the direct current (DC) through the series of LEDs 202. As shown, the output of a comparator/amplifier circuit 206 is connected to the power circuit 204 along with the output of a fixed pulse-width generator (PWG) circuit 208. As used herein, a "comparator/amplifier circuit" may be a comparator, an amplifier, or both. The inputs to the comparator/amplifier circuit 206 include a current sense signal 210, and a command signal 212 that is derived from a dimmed current reference signal 211 in a manner that is dependent on whether the PWG circuit 208 is activated or not activated. The activation of the PWG circuit 208 itself depends on whether the dimming command signal 213 is higher than a predetermined threshold level 216. In some embodiments, for example, a predetermined threshold level of twenty percent (20%) of the dimming command signal may be selected to initiate operation of the fixed PWG 208. Thus, during operation of the LED driver control system 200, as long as the dimming command signal is above 20%, the comparator 214 operates to disable the operation of the fixed PWG circuit 208. In such a case, the LED driver control system 200 operates in the same manner as described above with regard to the LED driver 100 of FIG. 1A.

However, as the dimming command signal diminishes so that it reaches the predetermined threshold level of 20%, then the power circuit 204 is controlled to be "On" and "Off" with a fixed 20% duty-cycle at a frequency ranging between one hundred hertz (100 Hz) to two kilohertz (2 kHz). It should be understood that this duty cycle is fixed, and that it is either activated or not activated. Thus, no feedback mechanism and/or no modulation mechanism is/are required.

Referring again to FIG. 2A, the main loop, consisting of comparator/amplifier 206 and power circuit 204, stays in control by automatically adjusting the average load current to 20% of the full load value. This is accomplished by increasing the value of the dimmed reference signal 211 by a factor equal to the inverse of the fixed duty cycle selected for the PWG 208. For instance, if the selected PWG duty cycle is 20%, the dimming current reference signal 211 is automatically increased by a factor of five because one divided by 20% equals five (1/0.2=5). Accordingly, when the command signal 212 decreases to ten percent (10%) of the full load level, flicker-free operation of the LED light source 202 is still maintained, while obtaining 2% dimming (10% amplitude reduction and 20% duty ratio for a total average output current of 2%).

Accordingly, instead of utilizing amplitude control to achieve higher level dimming of an LED light source and then using PWM control for lower level dimming of the LED light source (as taught by the prior art), the present LED driver control system 200 imposes a fixed PWG regime (fixed duty cycle) when the dimming command falls below a predetermined threshold value (in the above described example, the threshold value is 20%, but other choices are possible and/or permissible). Such operation can be achieved with a simple circuit rather than by using a full PWM modulator, to save cost. For example, an extremely simple timing circuit, such as a fixed 555-type timer circuit or a ripple counter circuit, could be used to implement the fixed PWG component 208 of FIG. 2A.

Accordingly, flicker-free dimming down to 2% of the LED light source nominal brightness can be achieved through the use of an inexpensive and simple fixed PWG regime and with the use of only one control mechanism (current amplitude), rather than by utilizing two control mechanisms as used by previous art.

Figure 2B:
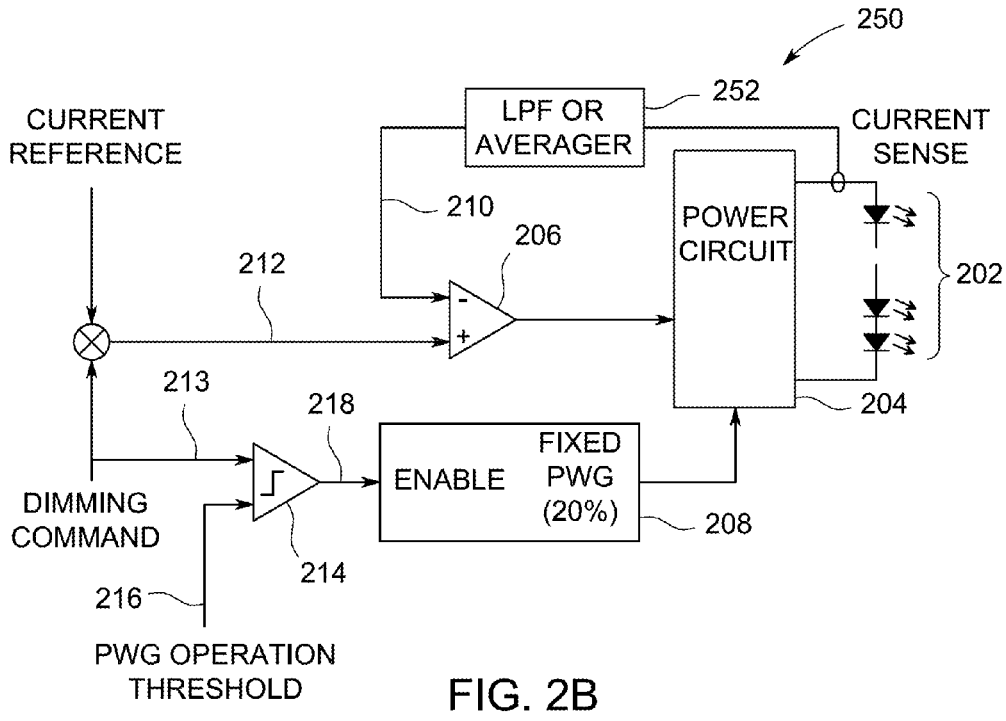
FIG. 2B is a schematic block diagram of an LED dimming circuit in accordance with aspects of another embodiment of the present invention.

FIG. 2B is a schematic circuit diagram of an LED driver control system 250 according to another embodiment. In this implementation, the system includes a power circuit 204 (which may include an integrated circuit (IC) for control of a boost, buck, buck-boost. SEPIC, hysteretic, or flyback power topologies and the like) which operates to control the direct current (DC) through the series of LEDs 202. As shown, the output of a comparator/amplifier circuit 206 is connected to the power circuit 204 along with the output of a fixed pulse-width generator (PWG) circuit 208. The inputs to the comparator/amplifier circuit 206 include a current sense signal 210, and a dimmed current reference signal 212. The averager circuit 252 (which, in its simplest form, may be a low pass filter (LPF)) operates to extract the average value of the LED current. The dimming command signal 213 is input to a comparator circuit 214 along with a pre-selected or predetermined PWG operation threshold signal 216. In an example, a predetermined threshold level of twenty percent (20%) of the dimming command signal may be selected to initiate operation of the fixed PWG 208. Thus, during operation of the LED driver control system 250, as long as the dimming command signal is above 20%, the comparator 214 operates to disable the operation of the fixed PWG circuit 208. In such a case, the LED driver control system 250 operates in the same manner as the LED driver 100 of FIG. 1A.

However, as the dimming command signal diminishes so that it reaches the predetermined threshold level of 20%, then the power circuit 204 is controlled to be "On" and "Off" with a fixed 20% duty-cycle at a frequency ranging between one hundred hertz (100 Hz) to two kilohertz (2 kHz). Thus, this duty cycle is fixed, as it is either activated or not activated. Thus, no feedback mechanism and/or no modulation mechanism is/are required. Accordingly, due to the presence of averager circuit 252, in order for the main loop (which consists of the comparator/amplifier circuit 206 and the power circuit 204 and the averager circuit 252) to stay in control when the fixed duty cycle PWG is activated, the current amplitude level during the "On" time is automatically adjusted by the control loop so that the load current average is 20% of the full load level. Again, flicker-free dimming down to 2% of the LED light source nominal brightness can be achieved through the use of an inexpensive and simple fixed PWG regime and with the use of only one control mechanism (current amplitude), rather than by utilizing two control mechanisms as used by previous art.

Figure 3:
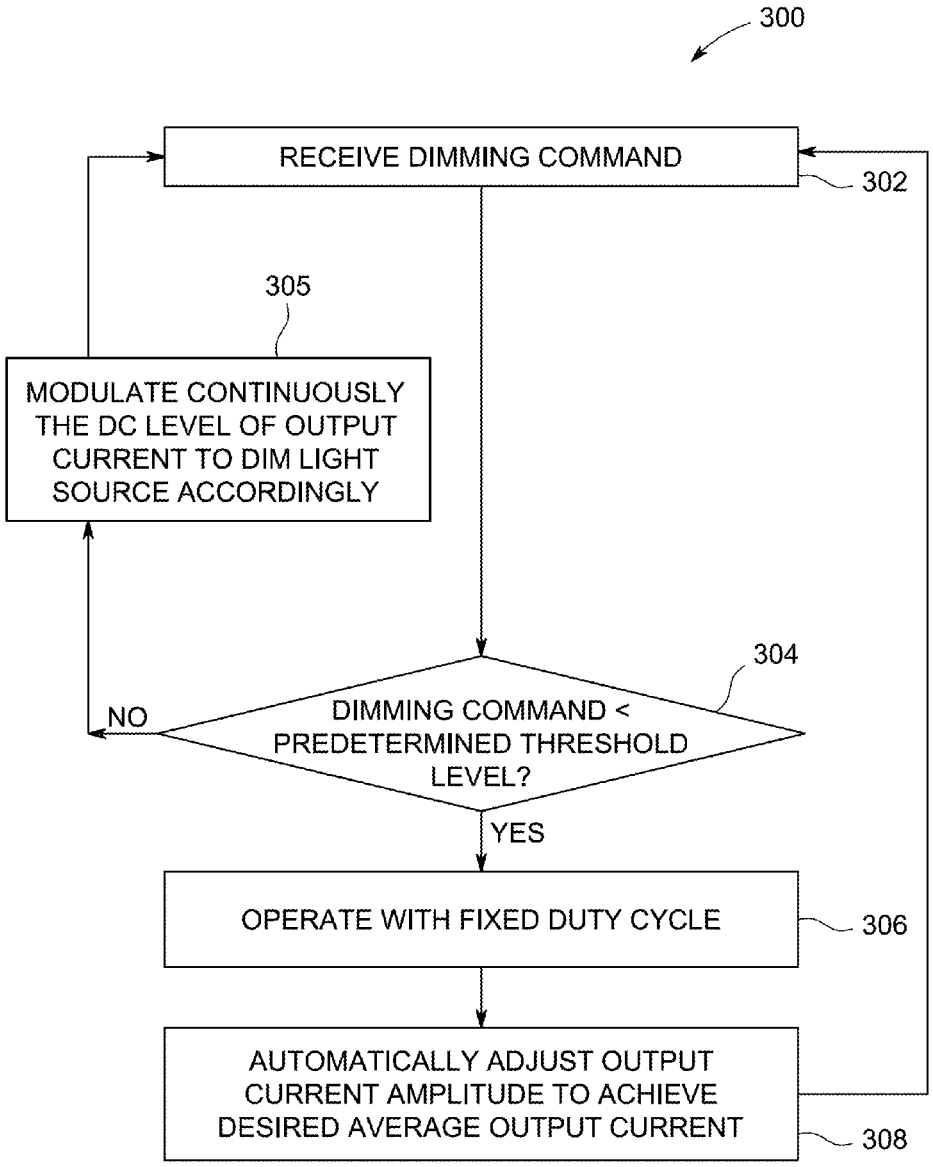
FIG. 3 is a flowchart illustrating a dimming method in accordance with aspects of the present invention.

FIG. 3 is a flowchart of a process 300 for controlling the brightness of an LED light source according to an embodiment. For example, a dimming command signal may be received 302 by an LED driver control circuit. If such command is above (not less than or equal to) a predetermined threshold level in step 304, then the process branches to step 305 wherein amplitude modulation of the DC current level continues until the appropriate level of dimness is achieved (in some embodiments, a person may wish to downwardly adjust the brightness level of the LED light source, to make it less bright, and thus he or she could operate a dimming switch or other dimming control circuitry which in turn transmits such a dimming command.) But if in step 304 the dimming command equals to or is lower than the predetermined threshold level, then the LED driver control circuit initiates 306 operation with a fixed duty cycle by using a fixed pulse width (PW) control signal having a fixed duty cycle. Next, the LED driver control circuit automatically adjusts 308 the load current amplitude to the required value (nominal current level) that will achieve the desired average current through the LED string. The process branches back to set 302 or restarts when a new dimming command is received.

Advantageously, the described LED driver control systems 200 and 250, and the process 300, may allow the LED light source dimming mechanism to never drive the LEDs with an instantaneous load current that is so low that flickering could result, and furthermore may prevent any significant color shift in the LEDs. Moreover, dimming operation is typically accomplished utilizing only amplitude control, and thus can be without the use of two control mechanisms (one for current amplitude control and the other for PWM control). Yet further, dimming can beneficially be accomplished with fewer components which may result in increased circuit reliability and lower cost.

The above description and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A light emitting diode (LED) light source apparatus, comprising:

at least one LED: and a driver control circuit for controlling the brightness of the at least one LED, wherein the driver control circuit comprises:

a power circuit operable to receive input power and to generate a direct current to power the at least one LED;

at least one of a comparator or an amplifier having a current sense signal input and a dimmed current reference command signal input, wherein the at least one of a comparator or an amplifier generates a control signal output that controls the power circuit to dim the at least one LED by decreasing the amplitude of LED current when the control signal is above a predetermined threshold;

a fixed pulse width generator (PWG) having an output connected to the power circuit, wherein the fixed PWG is configured to operate with a predetermined fixed duty cycle; and a comparator circuit having a predetermined threshold signal input and a dimming command signal input, wherein when the dimming command signal is above the predetermined threshold the comparator circuit disables the fixed PWG to dim the at least one LED, and wherein the comparator circuit enables the fixed PWG when the dimming command signal decreases below the predetermined threshold level resulting in the power converter circuit being controlled On-Off with the predetermined fixed duty cycle, and wherein the current amplitude level is automatically adjusted in response to the dimming command signal and the activation of the PWG in order to further dim the at least one LED.

2. The apparatus of claim 1, wherein the driver control circuit further comprises at least one of an averager circuit or a low-pass filter having an output connected to the at least one of the comparator or amplifier, wherein the averager circuit or low-pass filter operates to extract the average value of the sensed load current.

3. The apparatus of claim 1, wherein the power circuit further comprises an integrated circuit (IC) including one for controlling of a boost, buck, buck-boost, SEPIC, hysteretic, or flyback-type power topology.

4. The apparatus of claim 1, wherein the fixed PWG component comprises one of a fixed 555 timer circuit or a ripple counter circuit.

5. The apparatus of claim 1, wherein the power converter circuit is controlled On-Off within a frequency range of 100 Hertz to 2 Kilohertz.

6. An LED driver for controlling the brightness of an LED light source, comprising:

a power circuit operable to receive an alternating current or direct current input and to generate a direct current to power at least one LED of an LED light source;

at least one of a comparator or amplifier having a current sense signal input and a dimmed current reference signal input, wherein the at least one of a comparator or amplifier generates a control signal output that controls the power circuit to dim the at least one LED by decreasing the amplitude of LED current when the control signal is above a predetermined threshold;

a fixed pulse width generator (PWG) having an output connected to the power converter circuit, wherein the fixed PWG is configured to operate with a predetermined fixed duty cycle; and a comparator circuit having a predetermined threshold signal input and a dimming command signal input, wherein when the dimming command signal is above the predetermined threshold the comparator circuit disables the fixed PWG to dim the at least one LED, and wherein the comparator circuit enables the fixed PWG when the dimming command signal decreases below the predetermined threshold level resulting in the power converter circuit being controlled On-Off with the predetermined fixed duty cycle, and wherein the current amplitude level is automatically adjusted in response to the dimming command signal and the activation of the PWG in order to further dim the at least one LED.

7. The apparatus of claim 6, further comprising at least one of an averager circuit or a low-pass filter having an output connected to the at least one of the comparator or amplifier, wherein the averager circuit or low-pass filter operates to extract the average value of the sensed load current.

8. The apparatus of claim 6, wherein the power circuit further comprises an integrated circuit (IC) for controlling one of a boost, buck, buck-boost, SEPIC, hysteretic, or flyback-type topology.

9. The apparatus of claim 6, wherein the fixed PWM component comprises one of a fixed 555 timer circuit or a ripple counter circuit.

10. The apparatus of claim 6, wherein the power converter circuit is controlled On-Off within a frequency range of 100 Hertz to 2 Kilohertz.

11. A method for controlling brightness of an LED light source, comprising:

receiving, by an LED driver control circuit, a dimming command signal to dim an LED light source;

modulating a continuous direct current (DC) level to dim the LED light source;

determining that a predetermined threshold level is reached;

initiating a fixed pulse width generator (PWG) control signal having a fixed duty cycle;

automatically adjusting the LED current amplitude to its nominal current level; and decreasing, by the LED driver control circuit, the current amplitude while the fixed PWG control signal is active to achieve commanded lower dimming of the LED light source.

12. The method of claim 11, wherein the predetermined threshold level comprises a percentage of a dimming range.

13. The method of claim 12, wherein the predetermined threshold is ten percent.

14. The method of claim 11, wherein the duty cycle of the fixed PWG control signal comprises a percentage of a peak current.

15. The method of claim 14, wherein the duty cycle is twenty-percent.

16. The method of claim 11, further comprising:

determining that the dimming command signal is greater than the threshold level; and modulating the continuous direct current (DC) level to dim the LED light source.

* * * * *

UNITED STATES PATENT AND TRADEMARK OFFICE

CERTIFICATE OF CORRECTION

PATENT NO. : 8,816,604 B2
APPLICATION NO. : 13/566105
DATED : August 26, 2014
INVENTOR(S) : Carli It is certified that error appears in the above-identified patent and that said Letters Patent is hereby corrected as shown below:

In the Specification

In Column 2, Line 26, delete “source.” and insert -- source, --, therefor.

In Column 5, Line 42, delete “buck-boost.” and insert -- buck-boost, --, therefor.

In the Claims

In Column 6, Line 67, in Claim 1, delete “LED:” and insert -- LED; --, therefor.

Signed and Sealed this
Twenty-fifth Day of August, 2015

Michelle K. Lee

Michelle K. Lee
*Director of the United States Patent and Trademark Office*